US006129988A

United States Patent [19]

Vance et al.

[11] Patent Number: 6,129,988

[45] Date of Patent: Oct. 10, 2000

[54] GASEOUS MODIFICATION OF MCRALY COATINGS

[75] Inventors: Steven J. Vance, Orlando; John G. Goedjen, Oviedo; Stephen M. Sabol, Orlando; Kelly M. Sloan, Longwood, all of Fla.

[73] Assignee: Siemens Westinghouse Power Corporation, Orlando, Fla.

[21] Appl. No.: 09/134,049

[22] Filed: Aug. 14, 1998

[51] Int. Cl.[7] ..... B32B 9/00; C23C 8/20; C23C 8/24; C23C 8/30

[52] U.S. Cl. ..... 428/469; 428/472; 428/698; 428/701; 148/206; 148/218; 148/230; 148/238

[58] Field of Search ..... 148/206, 207, 148/218, 230, 238; 428/469, 472, 698, 701

[56] References Cited

U.S. PATENT DOCUMENTS 4,237,193 12/1980 Jackson et al. ..... 428/678
4,275,124 6/1981 McComas et al. ..... 428/564
4,419,416 12/1983 Gupta et al. ..... 428/656
5,035,957 7/1991 Bartlett et al. ..... 428/552
5,891,267 4/1999 Schaeffer et al. ..... 148/206

OTHER PUBLICATIONS

O. Knotek et al., "Diffusion Barrier Coatings With Active Bonding, Designed For Gas Turbine Blades," *Surface and Coatings Technology*, 68/69 (1994) pp. 22–26.

A.A. Kodentsov et al., "High Temperature Nitridation of Ni—Cr Alloys," *Metallurgical and Materials Transactions A*,vol. 27A, No. 1, Jan. 1996, pp. 59–69.

*Primary Examiner*—Timothy M. Speer
*Assistant Examiner*—Bryant Young
*Attorney, Agent, or Firm*—Eckert Seamans Cherin & Mellott, LLC

[57] ABSTRACT

The present invention generally describes methods for modifying MCrAlY coatings by using gaseous carburization, gaseous nitriding or gaseous carbonitriding. The modified MCrAlY coatings are useful in thermal barrier coating systems, which may be used in gas turbine engines.

6 Claims, No Drawings

GASEOUS MODIFICATION OF MCRALY COATINGS

GOVERNMENT INTEREST

This invention was made with government support under Contract No. DE-FC21-95MC32267, awarded by the United States Department of Energy. The government has certain rights in this invention.

FIELD OF THE INVENTION

The present invention generally describes methods for modifying MCrAlY coatings using gaseous carburization, gaseous nitriding or gaseous carbonitriding. The modified MCrAlY coatings are useful in thermal barrier coating systems, which may be used in gas turbine engines.

BACKGROUND OF THE INVENTION

In gas turbine applications, coatings that have MCrAlY compositions are commonly used as oxidation resistant overlay coatings and as bond coatings for thermal barrier coating systems. The MCrAlY coating forms an aluminum oxide layer (i.e., a thermally grown oxide layer) that acts as an oxidation barrier. The composition of the MCrAlY coating is similar to many superalloys; however, there are many alloying additions made to the superalloys to improve their high temperature properties. In thermal barrier coating systems, alloying elements from the substrate diffuse through the MCrAlY coating during high temperature operations. The diffusing elements (e.g., Ta, Ti and Hf) tend to combine with the thermally grown oxide layer and reduce its effectiveness as an oxidation barrier. This results in increased oxidation rates, which leads to the failure of the thermal barrier coating system due to accelerated oxidation and growth of the thermally grown oxide layer.

Platinum modified MCrAlY coatings have been demonstrated to out-perform standard MCrAlY coatings. The platinum combines with the MCrAlY to form a Pt—Al—M phase that getters the elements that diffuse up from the substrate. The incorporation of the alloying elements from the substrate slows the degradation of the oxide layer and extends the life of the thermal barrier coating. Platinum modification improves coating life; however, platinum modified coatings are expensive, which may be prohibitive for some applications.

There is a need in the art for improved coating systems that reduce diffusion of elements from the substrate to the thermally grown oxide layer in order to increase coating life. The present invention is directed to these, as well as other, important ends.

SUMMARY OF THE INVENTION

The present invention describes methods of modifying MCrAlY coatings comprising treating an MCrAlY bond coating with gaseous carburization, gaseous nitriding or gaseous carbonitriding, wherein M is Cr, Co, Ni, Fe or a combination thereof. Preferably, the MCrAlY bond coating layer is covered by a ceramic coating layer prior to the gaseous carburization treatment.

The present invention also describes thermal barrier coating systems comprising a ceramic coating layer, a MCrAlY bond coating layer and a substrate, wherein the MCrAlY bond coating layer comprises carbides, nitrides and/or carbonitrides.

These and other aspects of the present invention will become clearer from the following detailed description.

DETAILED DESCRIPTION OF THE INVENTION

The present invention generally describes processes for modifying MCrAlY coatings by using gaseous carburization, gaseous nitriding or gaseous carbonitriding.

Carburization of the MCrAlY coating will result in the formation of carbide phases, such as MC, $M_{23}C_6$ and $M_6C$. Generally, the carbides are of the formula $M_xC_y$, where the ratio of x to y ranges from about 1 to about 6. The carbides that form in the bond coating will be primarily $Cr_xC_y$, wherein the ratio of x to y ranges from about 1 to about 6. Elements used for superalloy strengthening tend to form carbides, such as HfC, $Mo_2C$, TiC, TaC, WC and the like. These alloying additions diffuse into the bond coat during service. These elements can combine with the preexisting $Cr_xC_y$, to form mixed metal carbides (e.g., $Cr_{21}(Mo, W)_2C_6$).

Modifying MCrAlY coatings may be accomplished by heating the coating to a temperature between 1400–2000 degrees F for about 1 hour (at higher temperatures) to about 24 hours (at lower temperatures) followed by quenching to a temperature below 1400 degrees F. For carburization, this procedure will be followed in the presence of methane and carbon monoxide. For nitridation, this procedure will be followed in the presence of gaseous amonia, hydrogen and nitrogen. For carbonitriding, this procedure will be followed in the presence of all of the above named compounds.

In the preferred embodiment, the modification layer should be from about 1 to about 10 mils (0.001" to 0.010") thick depending on the original MCrAlY thickness.

The formation of the mixed metal carbides will reduce the number of alloying addition elements available for incorporation in the thermally grown oxide layer, thereby preventing or significantly delaying its degradation.

Nitriding of the MCrAlY coating will result in the formation of nitride phases. Nitrides of the types MN and $M_2N$ can result. The nitrides that form in the bond coating will be primarily Cr or Al nitrides. Elements used for superalloy strengthening diffuse into the MCrAlY bond coating. These alloying additions that diffuse into the bond coating can combine with the pre-existing AlN, CrN or $Cr_2N$ to form mixed metal nitrides like $(Cr,Mo)_2N$. The formation of these mixed metal nitrides will reduce the degradation of the thermally grown oxide layer that typically results from inclusion of alloying additions in the oxide scale.

Carbonitriding can also be used to modify an MCrAlY bond coating. Carbon and nitrogen react with the MCrAlY coating to form a combination of carbides, nitrides or mixed carbonitrides (e.g., $M_2(C,N)$). These phases will incorporate substrate alloying elements as discussed above.

Gaseous carbonitriding, carburizing or nitriding heat treatments result in the formation of carbides and nitrides that make adhesion of subsequent coating layers difficult. Because thermal barrier coating layers are generally porous, gaseous heat treating can be performed after an air plasma spray (APS) ceramic top coating is applied.

A typial ceramic composition is zirconia stabilized by 7% yttrium. The air plasma spray ceramic coating adheres to the unmodified MCrAlY coating, and the subsequent gaseous heat treatment will modify the MCrAlY coating. The preferred method of applying the ceramic top coat is by air plasma spray, however, electron beam physical vapor deposition (EB-PVD) may also be used. A typical thickness of the ceramic top coat for the practice of this invention is 3 to about 15 mils (0.003" to 0.015") with an occassional use at 40 mils (0.040").

The use of gaseous heat treatment to modify MCrAlY bond coatings will provide gas turbine component life extensions by improving the integrity of the protective thermally grown oxide layer that forms during service. These methods will also provide a substantial cost savings by eliminating the use of platinum. Typical gas turbine components to which this invention is directed include turbine blades, vanes, and combustor components made of Co-based or Ni-based superalloy.

Various modifications of the invention in addition to those shown and described herein will be apparent to one skilled in the art from the foregoing description. Such modifications are also intended to fall within the scope of the appended claims.

What is claimed is:

1. A method of modifying a MCrAlY bond coating layer formed on a substrate comprising the steps of:

coating a MCrAlY bond coating layer with a ceramic; and treating said ceramic coated MCrAlY bond coating layer with gaseous carburizing, gaseous nitriding or gaseous carbonitriding, wherein M is at least one of Cr, Co, Ni, Fe or a combination thereof.

2. The method of claim 1, wherein the ceramic coating layer comprises 7% yttrium stabilized zirconia.

3. The method of claim 1, wherein the ceramic coated MCrAlY bond coating layer is treated with gaseous carburizing.

4. A method of modifying a MCrAlY bond coating layer formed on a substrate comprising the steps of:

coating a MCrAlY bond coating layer with a ceramic; and treating said ceramic coated MCrAlY bond coating layer with gaseous nitriding, wherein M is at least one of Cr, Co, Ni, Fe or a combination Thereof.

5. A method of modifying a MCrAlY bond coating layer formed on a substrate comprising the steps of:

coating a MCrAlY bond coating layer with a ceramic; and treating said ceramic coated MCrAlY bond coating layer with gaseous carbonitriding, wherein M is at least one of Cr, Co, Ni, Fe or a combination thereof.

6. A thermal barrier coating system comprising a ceramic coating layer, a MCrAlY bond coating layer and a substrate, wherein the MCrAlY bond coating layer comprises nitrides or carbonitrides.

* * * * *